US007963312B2

(12) United States Patent
Okachi et al.

(10) Patent No.: US 7,963,312 B2
(45) Date of Patent: Jun. 21, 2011

(54) SCREEN APPARATUS

(75) Inventors: Yasubumi Okachi, Kanagawa (JP); Yuichiro Nishioka, Kanagawa (JP)

(73) Assignee: Metaco Inc., Tokyo (JP)

( * ) Notice: Subject to any disclaimer, the term of this patent is extended or adjusted under 35 U.S.C. 154(b) by 111 days.

(21) Appl. No.: 12/308,701

(22) PCT Filed: Jun. 21, 2007

(86) PCT No.: PCT/JP2007/062506

§ 371 (c)(1),
(2), (4) Date: Apr. 17, 2009

(87) PCT Pub. No.: WO2007/148756

PCT Pub. Date: Dec. 27, 2007

(65) Prior Publication Data

US 2009/0277592 A1 Nov. 12, 2009

(30) Foreign Application Priority Data

Jun. 23, 2006 (JP) ..... 2006-174566

(51) Int. Cl.
*A47H 1/00* (2006.01)

(52) U.S. Cl. ..... 160/31; 160/84.06; 160/194

(58) Field of Classification Search ..... 160/84.06, 160/172 R, 84.04, 84.05
See application file for complete search history.

(56) References Cited

U.S. PATENT DOCUMENTS

| | | | | |
|---|---|---|---|---|
| 6,186,212 | B1 | 2/2001 | Tsuchida | |
| 6,273,173 | B1 * | 8/2001 | Lassen | 160/84.06 |
| 6,318,438 | B1 * | 11/2001 | Uno et al. | 160/31 |
| 6,978,820 | B2 * | 12/2005 | Aoki | 160/84.06 |
| 7,117,918 | B2 * | 10/2006 | Franssen | 160/84.06 |
| 7,395,850 | B2 * | 7/2008 | Chino et al. | 160/243 |
| 7,472,738 | B2 * | 1/2009 | Kamosawa et al. | 160/84.06 |
| 7,669,632 | B2 * | 3/2010 | Moriya et al. | 160/31 |
| 7,694,711 | B2 * | 4/2010 | Okachi et al. | 160/245 |
| 7,717,152 | B2 * | 5/2010 | Moriya et al. | 160/31 |
| 2004/0016513 | A1 * | 1/2004 | Hung | 160/84.06 |
| 2004/0159410 | A1 * | 8/2004 | Welfonder | 160/84.06 |
| 2006/0162871 | A1 * | 7/2006 | Kamosawa et al. | 160/84.06 |
| 2007/0039698 | A1 * | 2/2007 | Chino et al. | 160/84.06 |
| 2007/0068633 | A1 * | 3/2007 | Chino et al. | 160/31 |
| 2008/0135189 | A1 * | 6/2008 | Okachi et al. | 160/84.06 |
| 2009/0020234 | A1 * | 1/2009 | Chino et al. | 160/31 |
| 2009/0277592 | A1 * | 11/2009 | Okachi et al. | 160/84.06 |

FOREIGN PATENT DOCUMENTS

| | | |
|---|---|---|
| JP | 9-268861 | 10/1997 |
| JP | 10-280837 | 10/1998 |
| JP | 2001-73655 | 3/2001 |
| JP | 3323461 | 6/2002 |

* cited by examiner

*Primary Examiner* — Blair M. Johnson
(74) *Attorney, Agent, or Firm* — Wenderoth, Lind & Ponack L.L.P.

(57) ABSTRACT

A screen is made to be able to be changed in a state in which the screen is made to be detachable from a screen attaching frame portion, a first connector is arranged at one end extracted from the screen of screen tension members penetrating the screen at a plurality of portions in a length direction, the one end is connected to a vicinity of a free end of a slide guide frame portion, other end of a jump member extracted to a screen attaching side is arranged with a second connector, the first connector and the second connector are made to be attachable and detachable to and from each other, and the slide guide frame portion is extracted from inside of the screen attaching frame portion.

5 Claims, 11 Drawing Sheets

SCREEN APPARATUS

BACKGROUND OF THE INVENTION

I. Technical Field

The present invention relates to a screen apparatus capable of interchanging a screen when the screen is stained or torn or the like.

II. Description of the Related Art

A screen apparatus as shown in FIG. 7 and FIG. 8 is an apparatus of resolving a restriction in installation when used as a light shielding and light dimming means of a curtain, a blind or the like, or a window screen, a partition wall or the like, further, realizing an excellent operability and shape stability of a screen (Japanese Patent No. 3323461).

The screen apparatus includes a pair of screen attaching frame portions 1 which are arranged so as to be opposed to each other and at least one of which is slidingly movable, and the two screen attaching frame portions 1 are attached with a screen 2 to be able to be contracted and developed between the two screen attaching frame portions 1. The screen 2 is formed from, a cloth, a net, a sheet or the like and contracted and developed in accordance with sliding movement of at least one of the screen attaching frame portions 1. The screen 2 attached with a plurality of pleats is preferably applied.

Further, the screen apparatus includes a slide guide frame portion 3 of guiding the sliding movement of the screen attaching frame portion 1 at a vicinity of at least one of end portions of the screen 2 which is not on a side of being attached to the screen attaching frame portion 1. The slide guide frame portion 3 is continuously provided to be formed with rigid units 4. As shown in FIG. 9, the rigid unit 4 includes a pair of side wall portions 5 arranged so as to oppose each other and a bridging portion 6 connecting the two side wall portions 5 to each other. The rigid unit 4 can include a projection 7 projected to an outer side on a side of one end portion of the side wall portion 5, and include a through hole 8 engageable with the projection 7 on a side of the other end portion, and the rigid units 4 can continuously be provided by fitting the projection 7 to the through hole 8 from a side of a back face of the side wall portion 5 between the rigid units 4 contiguous to each other. For example, according to the slide guide frame portion 3 formed by the rigid units 4, the rigid units 4 are made to be pivotable between contiguous ones thereof, and therefore, the slide guide frame portion 3 is provided with flexibility. As shown in FIG. 8, at least one end of the slide guide frame portion 3 is made to constitute a free end 3*a*, and is made to be able to be contained to and extracted from inside of the screen attaching frame portion 1.

On the other hand, when the slide guide frame portion 3 is extracted from inside of the screen attaching frame portion 1 in accordance with the sliding movement of the screen attaching frame portion 1, an extracted portion thereof maintains linearity. In order to maintain linearity, for example, the rigid unit 4 can be provided with a stepped difference 9 by notching a surface thereof at one end edge portion of the bridging portion 6 and a stepped difference 10 by notching a back face thereof at the other end edge portion thereof. The linearity of the slide guide frame portion 3 is maintained by restricting the rigid units 4 from being pivoted when the stepped difference 10 overlaps the stepped difference 9 between the rigid units 4 contiguous to each other. Further, the rigid unit 4 can be formed with a long hole 12 substantially in a crescent shape capable of receiving a small projection 11 by projecting the small projection 11 to an outer side at the side wall portion 5. In this case, the small projection 11 is inserted to the long hole 12 between the rigid units 4 contiguous to each other, and when the small projection 11 is brought into contact with one end of the long hole 12, the rigid unit 4 is restricted from being pivoted, and the linearity of the slide guide frame portion 3 is maintained.

According to the screen apparatus, the slide guide frame portion 3 for guiding the sliding movement of the screen attaching frame portion 1 is extracted from inside of the screen attaching frame portion 1 in accordance with the sliding movement of the screen attaching frame portion 1, further, contained, and therefore, the slide guide frame portion 3 is not a fixed frame always disposed at a constant position. This resolves the restriction in installation when used as a light shielding and light dimming means of a curtain, a blind or the like, or a screen window, a partition wall or the like. Further, the slide guide frame portion 3 is provided with the rigidity and the flexibility with an excellent balance since the slide guide frame portion 3 is formed from the rigid units 4, and an excellent operability and a shape stability of the screen 2 are realized.

Further, according to the screen apparatus, as shown by FIG. 10, the free ends 3*a* of the pair of slide guide frame portions 3 are connected to each other by a slide guide frame portion tension member 13 provided at inside of the screen attaching frame portion 1 for forming a loop in an 8-like shape, and fold back points 14 of the slide guide frame portion tension member 13 are arranged on a side opposed to a side of attaching the screen 2. For example, a string, a wire or the like is used for the slide guide frame portion tension member 13.

Amounts of moving the pair of slide guide frame portions 3 are made to be substantially equal to each other by the slide guide frame portion tension member 13 and the fold back points 14, and a smooth parallel movement of the screen attaching frame portion 1 is firmly realized.

Further, according to the screen apparatus shown in FIG. 10, although a side of the slide guide frame portion 3 opposed to the free end 3*a* is made to constitute a fixed line 3*b* and is fixed to the screen attaching frame portion 1, both ends of the slide guide frame portion 3 can be made to constitute the free ends 3*a*, in that case, both inner portions of the pair of screen attaching frame portions 1 are provided with the slide guide frame portion tension members 13 of forming the 8-like shape loops, and connected to the free ends 3*a* of the slide guide frame portion 3 and the fold back points 14 are arranged on the side opposed to the side of attaching the screen 2.

SUMMARY OF THE INVENTION

According to the above-described screen apparatus, as shown by FIG. 11, there is a case in which a plurality of pieces of screen tension members 15 of strings, wires or the like are expanded between the pair of screen attaching frame portions 1 by penetrating the screen 2 at a plurality of portions in a length direction with an object of ensuring a self supportability by supporting the screen 2, further, increasing a face strength of the screen 2 or the like. In this case, the respective screen tension members 15 are folded back at portions of the screen 2 attached to the screen attaching frame portion 1, and further folded back at fold back portions 16 provided on a side of the screen attaching frame portion 1 attached to the screen 2 to thereby generate a predetermined tension. One end of each screen tension member 15 is fixed to a vicinity of the free end 3*a* of the slide guide frame portion 3.

The following drawback has been found in the screen apparatus arranged with the screen tension member 15.

A stain can occur on the screen 2 by being using the screen. Although the stain can be wiped so as to be cleaned off to some degree by using water or a cleaning solution, when a stain or a tear occurs which cannot be wiped so as to be cleaned off, the screen 2 needs to be changed. However, when the screen 2 is removed, since the one end of the screen tension member 15 is fixed to the vicinity of the free end 3*a* of the slide guide frame portion 3, the slide guide frame portion 3 needs to be temporarily extracted from the screen attaching frame portion 1 completely. Further, when a new screen 2 is attached, it is necessary to carry out a wiring operation of hanging the screen tension member 15 around the fold back portion 16 at the inside of the screen attaching frame portion 1 and fixing the screen tension member 15 at the vicinity of the free end 3*a* of the slide guide frame portion 3. The slide guide frame portion 3 cannot be extracted and the screen tension member 15 cannot be wired at a portion of installing the screen apparatus, and therefore, the screen 2 is obliged to be changed by removing the entire screen apparatus and transporting the screen apparatus to an assembly factory. In this way, the change of the screen 2 takes time and labor.

The present invention has been carried out in view of the above-described situation and it is a problem thereof to provide a screen apparatus facilitating to change a screen and capable of change the screen at an installation portion without removing the screen apparatus.

A screen apparatus of the present invention is characterized by the following in order to resolve the above-described problem.

First, there is proposed a screen apparatus in which a pair of screen attaching frame portions which are arranged to oppose each other and at least one of which is slidingly movable are attached with a screen to be able to be contracted and developed between the two screen attaching frame portions, a pair of slide guide frame portions are arranged at vicinities of both end portions of the screen which do not constitute sides being attached to the screen attaching frame portions, the slide guide frame portion is formed by being continuously provided with a rigid unit having a pair of side wall portions arranged oppositely to each other and a bridging portion connecting the pair of side wall portions pivotably between continuous ones thereof, whereas the slide guide frame portion is provided with flexibility, at least one end thereof is made to constitute a free end and is made to be contained in and extracted from inside of the screen attaching frame portion, when extracted from inside of the screen attaching frame portion in accordance with a sliding movement of the screen attaching frame portion, an extracted portion of the slide guide frame portion maintains a linearity, further, free ends of the pair of slide guide frame portions are connected to each other by a slide guide frame portion tension member provided at inside of the screen attaching frame portion and forming a loop in an 8-like shape, and fold back points of the slide guide frame portion tension member are arranged on a side opposed to a side of attaching the screen, wherein the screen is made to be detachable from the screen attaching frame portion, a first connector is arranged at one ends extracted from the screen of screen tension members penetrating the screen at a plurality of portions in a length direction, the one end is connected to a vicinity of a free end of the slide guide frame portion, a second connector is arranged at other end of a jump member extracted to the screen attaching side, the first connector and the second connector are made to be attachable and detachable, in a state of extracting the slide guide frame portion from inside of the screen attaching frame portion, the screen is made to be able to be changed.

Second, in the above-described invention, a first fold back portion is provided at a portion of the screen attached to the screen attaching frame portion, the screen tension member is hung around the first fold back portion, a direction thereof is changed, a second fold back portion is provided on the screen attaching side of the screen attaching frame portion, the jump member is hung around the second fold back portion, the direction is changed, the first and the second connector which are coupled are made to be movable between the first and the second fold back portions.

Third, in the above-described invention, the first fold back portion is provided at one portion, all of a plurality of pieces of the screen tension members are folded to bend to the first fold back portion, and hung around the first fold back portion.

Fourth, in the above-described invention, the first fold back portion is made to be integral with the screen by being fixed to an attaching portion to the screen attaching frame portion of the screen by making an attaching height thereof adjustable.

According to the first invention, the screen is detachably attached to the screen attaching frame portion, the first connector arranged at one end of the screen tension member, and the second connector the one end of which is connected to the vicinity of the free end of the slide guide frame portion and which is arranged at the other end of the jump member extracted to the screen attaching side are made to be attachable and detachable, and therefore, the screen can be changed in a state of extracting the slide guide frame portion from the screen attaching frame portion to some degree. When the screen is detached from the screen attaching frame portion and the coupling of the first connector and the second connect or is released, the screen can be detached. When a new screen is attached, only the first connector and the second connector may be coupled and only the screen may be attached to the screen attaching frame portion. The screen is changed easily, and the screen can be changed at a portion of installation without detaching the screen apparatus. Also a user of the screen apparatus can change the screen.

According to the second invention, in addition to an effect of the above-described invention, the first fold back portion is provided at the attaching portion to the screen attaching frame portion of the screen, the screen tension member is hung around the first fold back portion, the direction is changed, the second fold back portion is provided at the screen attaching side of the screen attaching frame portion, the jump member is hung around the second fold back portion, the direction is changed, and therefore, in attaching the screen, complicated wiring is not needed, and changing operation is further facilitated. Further, the first and the second connectors which are coupled so as to be movable between the first and the second fold back portions, and therefore, it is not necessary to pass the first and the second connectors respectively through the first and the second fold back portions, the screen tension member and the jump member are smoothly moved in accordance with contraction and development of the screen.

According to the third invention, in addition to an effect of the above-described invention, the first fold back portion is provided at one portion, all of the plurality of pieces of the screen tension members are folded to bend to the first fold back portion, and hung around the first fold back portion, and therefore, a portion of the screen which is not related to expansion of the screen tension member can easily be cut, and a size of the screen prepared for maintenance can be reduced.

According to the fourth invention, in addition to the effect of the above-described invention, the first fold back portion is made to be integral with the screen by being fixed to the attaching portion to the screen attaching frame portion of the screen by making the first fold back portion adjustable in the attaching height, and therefore, the first fold back portion can be changed simultaneously with changing the screen. Although when the first fold back portion is arranged at a lower end portion of the screen, the first fold back portion easily damaged particularly by influence of sand, mud or the like, the fourth invention becomes effective in that case.

DETAILED DESCRIPTION OF THE INVENTION

Figure 1:
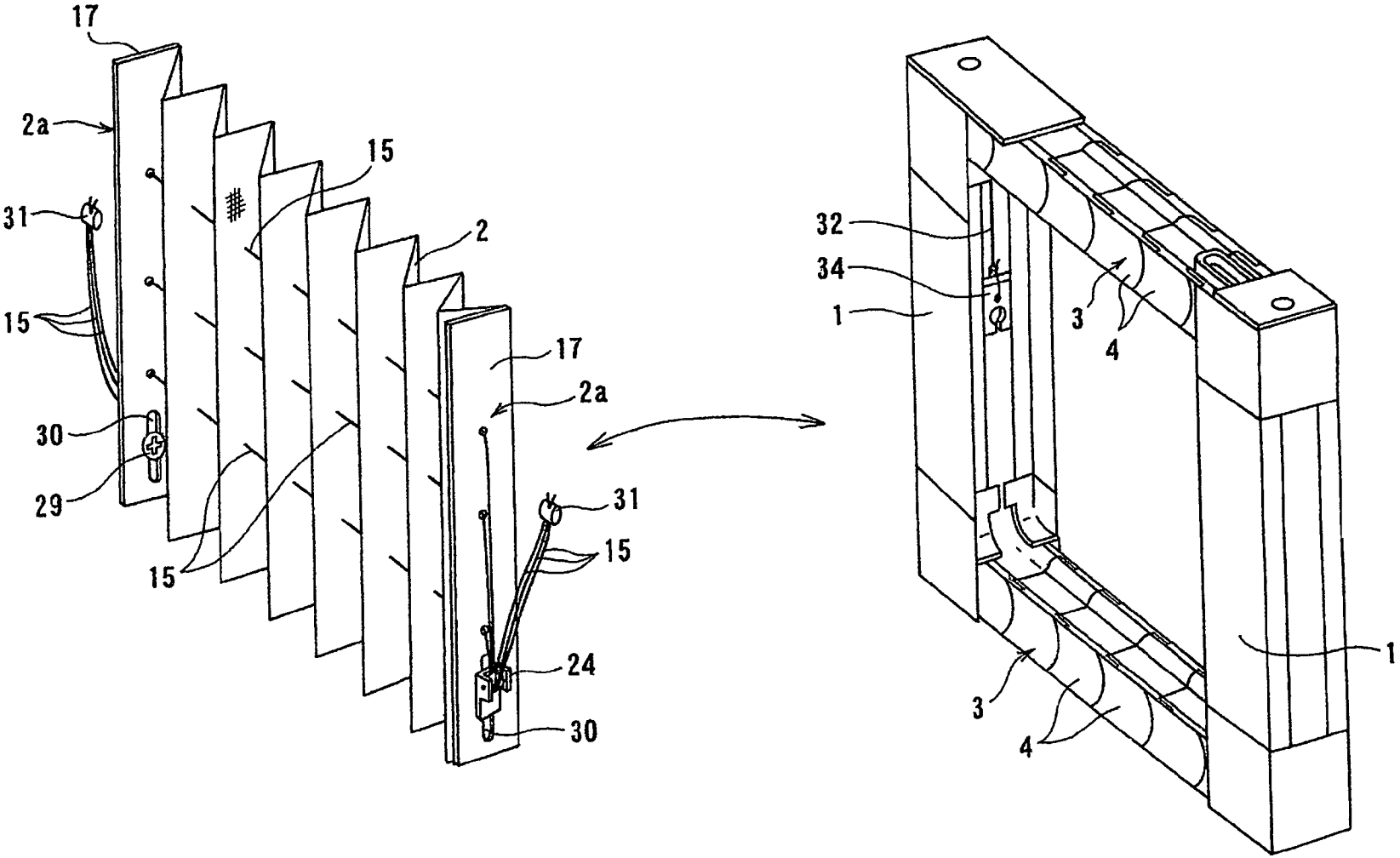
FIG. 1 is a disassembled perspective view showing an embodiment of a screen apparatus of the invention.
Figure 2:
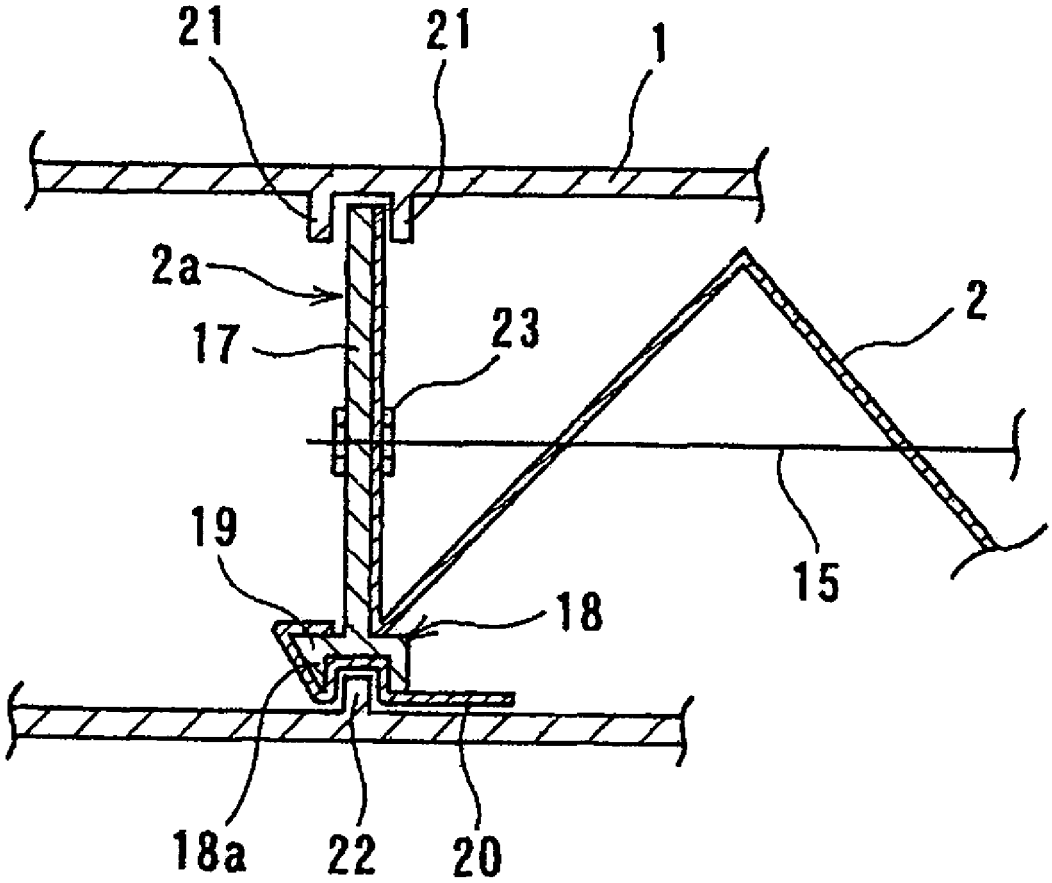
FIG. 2 is a sectional view of an essential portion showing a screen attaching frame portion and a portion of attaching a screen to the screen attaching frame portion according to the embodiment shown in FIG. 1.
Figure 11:
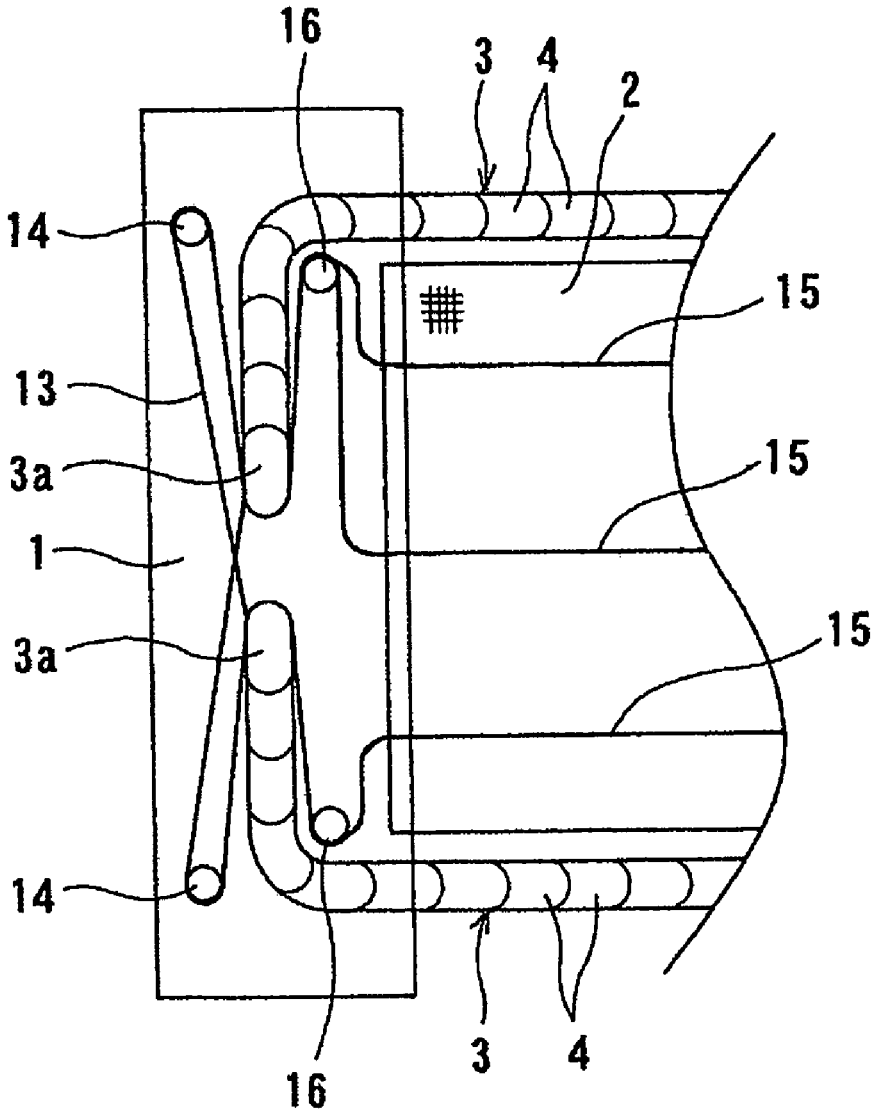
FIG. 11 is a sectional view of an essential portion showing a case of expanding a screen tension member in the screen apparatus shown in FIG. 10.

In a screen apparatus shown in FIG. 1 and FIG. 2, portions common to those of the screen apparatus shown in FIG. 11 are attached with the same notations and an explanation thereof will be omitted.

The screen 2 is formed from a cloth, a net, a sheet attached with a plurality of pleats and made to be contractible and developable in an accordion shape. The screen 2 is arranged with 3 pieces of the screen tension members 15 penetrating the screen 2 in a length direction at upper and lower as well as at center portions thereof. As the screen tension member 15, there can be adopted a pertinent one of, for example, a string, a wire or the like capable of generating a tension, ensuring self supportability and increasing a face strength by supporting the screen 2. A number of pieces thereof can pertinently be set in accordance with a height of the screen 2 and can be made to be a plural number of 2 pieces or more.

Further, the screen 2 is made to be detachable from the screen attaching frame portion 1. Attaching plates 17 which can be made of, for example, a resin or the like are fixed by being adhered, pasted or the like to the screen 2 on outer sides of attaching portions 2*a* at both left and right end portions of the screen 2. As shown by FIG. 2, one end portion in a height direction of the attaching plate 17 is formed with an engaging portion 18 having a section substantially in a channel-like shape. One engaging piece portion 18*a* of the engaging portion 18 opposed thereto is formed with a claw 19 skewedly projected from an outer side to an inner side. Further, the attaching plate 17 is provided with a detaching piece 20 extended from a back face to a surface of the claw 19 and to an outer side of the engaging portion 18 and along the inner portion of the engaging portion 18. The detaching piece 20 is fixed by being adhered, pasted or the like to the attaching plate 17 at a portion thereof overlapping the engaging portion 18.

When the screen 2 is attached to the screen attaching frame portion 1, the attaching portion 2*a* is inserted between two streaks of locking pieces 21 opposed to each and other projected from an inner wall face of one of the wall portions of the screen attaching frame portion 1. Additionally, locking pieces 21 are opposed to each other to an inner side at one end portion of the attaching plate 17 in a shape of a flat plate, successively, the attaching plate 17 is bent, the claw 19 is made to ride over one streak of an engaging piece 22 projected from an inner face of the other wall portion of the screen attaching frame portion 1 to an inner side, and the engaging piece 22 is engaged with an inner portion of the engaging portion 18. In detaching the screen 2 from the screen attaching frame portion 1, by pulling the detaching piece 18 in a length direction of the screen 2, a periphery of the engaging portion 18 is bent, the claw 19 is made to ride over the engaging piece 22, and an engagement between the engaging portion 18 and the engaging piece 22 is released. Thereafter, the attaching portion 2*a* on the side of the one end portion of the attaching plate 17 in the shape of the flat plate locked by the locking pieces 21 is drawn.

In this way, the screen 2 is attachable and detachable to and from the screen attaching frame portion 1 and attachment and detachment thereof are facilitated.

As shown by FIG. 2, a portion of the attaching portion 2*a* of the screen 2 penetrated by the screen tension member 15 is attached with a guide piece 23 in a shape of a circular cylinder to penetrate the attaching plate 17 and head and tail of an end portion of the screen 2 fixed to the attaching plate 17. As shown by FIG. 1, all of 3 pieces of the screen tension members 15 are folded to bend to a lower side and extracted from the screen 2 at the guide pieces 23. The guide piece 23 is finished to a smooth face at an inner face and an inner edge thereof such that friction with the screen tension member 15 is reduced as much as possible. Also the guide piece 23 can be made of a resin.

Three pieces of the screen tension members 15 extracted from the screen 2 are hung around a first fold back portion 24 provided at a lower end portion of the attaching portion 2*a* to change directions thereof from a lower side to an upper side.

Figure 3:
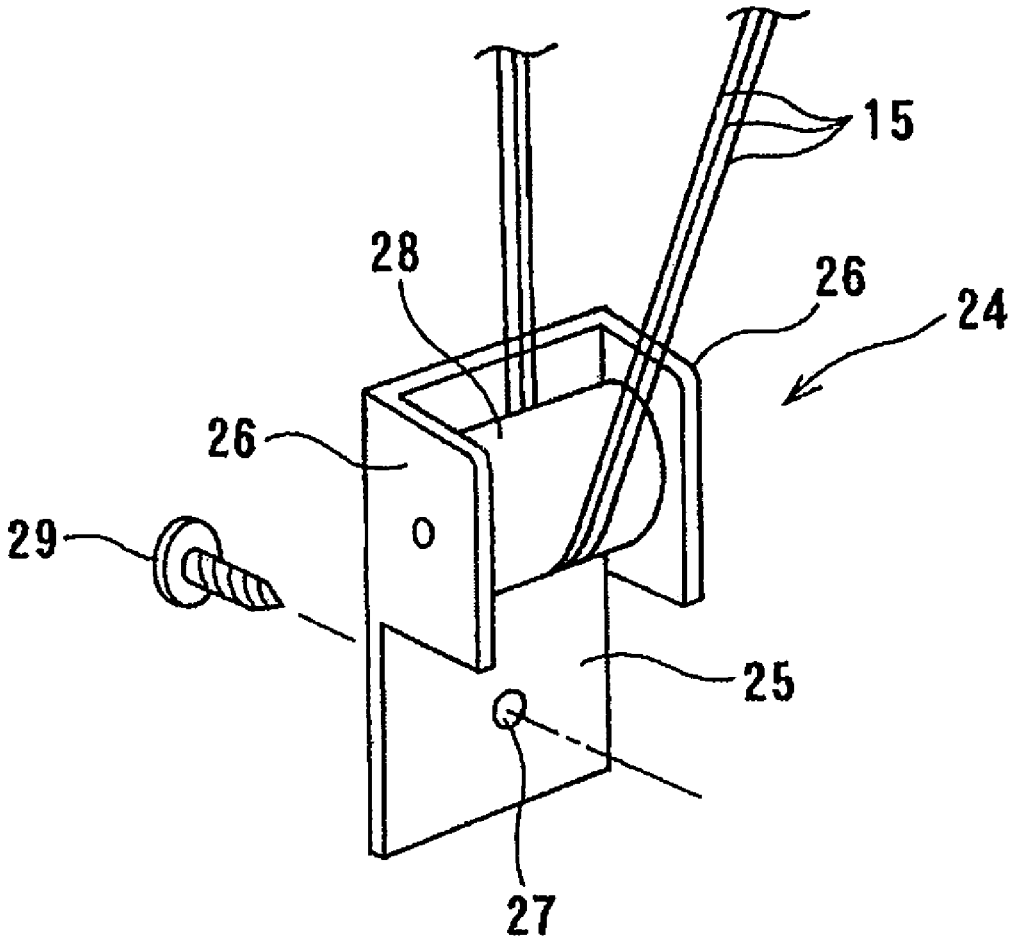
FIG. 3 is a perspective view enlarging to show a first fold back portion shown in FIG. 1.

As shown in FIG. 3, the first fold back portion 24 includes a fixing piece 25. A pair of support pieces 26 opposed to each other extend from both left and right sides of fixing piece 25 from an upper end to a center thereof. A screw hole 27 is formed at the fixing piece 25 on a lower side of the support piece 26. A roller 28 is axially supported between the two support pieces 26, the roller 28 is made to be rotatable. An interval capable of inserting the screen tension member 15 is provided between the roller 28 and the fixing piece 25.

As shown in FIG. 1, the first fold back portion 24 is arranged to bring the fixing piece 25 into contact with the attaching plate 17 fixed to the attaching portion 2*a* of the screen 2, and direct the support piece 26 to an outer side, and is fixed by screwing a screw 29 from a back side of the attaching plate 17 to the screw hole 27. The attaching portion 2*a* is formed with a long hole 30 at a lower end portion thereof in a height direction of the screen 2 and a height of attaching the first fold back portion 24 is made to be adjustable. The first fold back portion 24 is made to be integral with the screen 2 by screwing.

Three pieces of the screen tension members 15 are inserted between the fixing piece 25 and the roller 28 at the first fold back portion 24, and hung around an outer periphery of the roller 28 to change directions from the lower side to the upper side. Further, as shown in FIG. 1, front ends of 3 pieces of the screen tension members 15 are summarized and arranged with a first connector 31.

Figure 4:
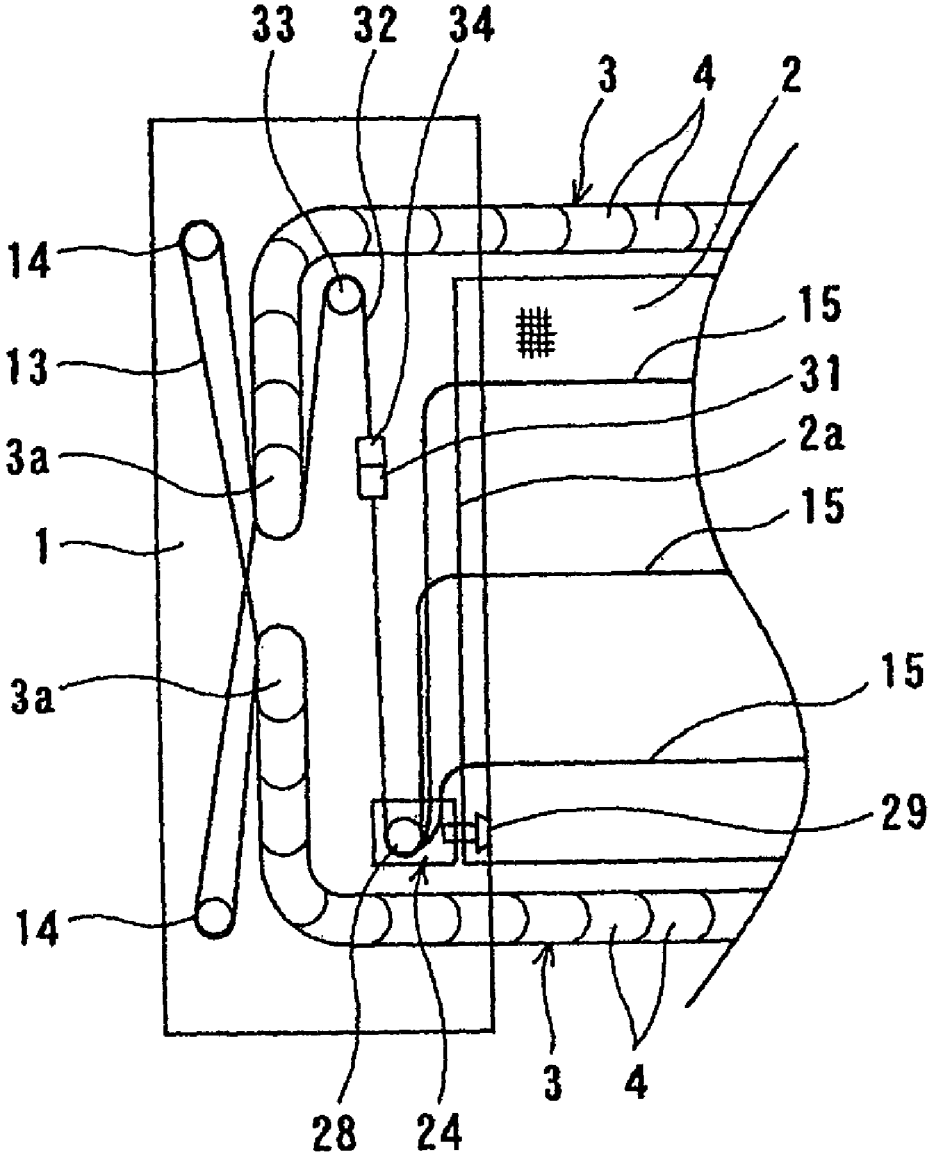
FIG. 4 is an outline constitution view showing the screen attaching frame portion and the portion of attaching the screen to the screen attaching frame portion according to the embodiment shown in FIG. 1.

On the other hand, at an inner portion of the screen attaching frame portion 1, as shown by FIG. 4, a jump member 32 is connected to a vicinity of the free end 3*a* of the slide guide frame portion 3 on an upper side at the inside of the pair of slide guide frame portions 3 connected to each other by the slide guide frame portion tension member 13 forming a loop in an 8-like shape. One end thereof is connected to the vicinity of the free end 3*a* of the slide guide frame portion 3 and other end thereof is extracted to a side of attaching the screen 2. The jump member 32 can be constituted by a wire member of a string, a ribbon, a wire or the like and a material thereof is not particularly restricted.

Further, at the inner portion of the screen attaching frame portion 1, a second fold back portion 33 is provided at an upper portion on the side of attaching the screen 2, the jump member 32 is hung around the second fold back portion 33 to change the direction from the upper side to the lower side and a front end thereof is arranged with a second connector 34. The second connector 34 is made to be attachable and detachable to and from the first connector 31. Therefore, the screen tension member 15 is made to be able to be connected to and released from the slide guide frame portion 3 by way of the jump member 32 by attaching and detaching the first connector 31 and the second connector 34 and connecting and releasing thereof are facilitated. The first connector 31 and the second connector 34 which are coupled are disposed between the first fold back portion 24 and the second fold back portion 33 and made to be movable between the two fold back portions 24, 33.

Figure 5:
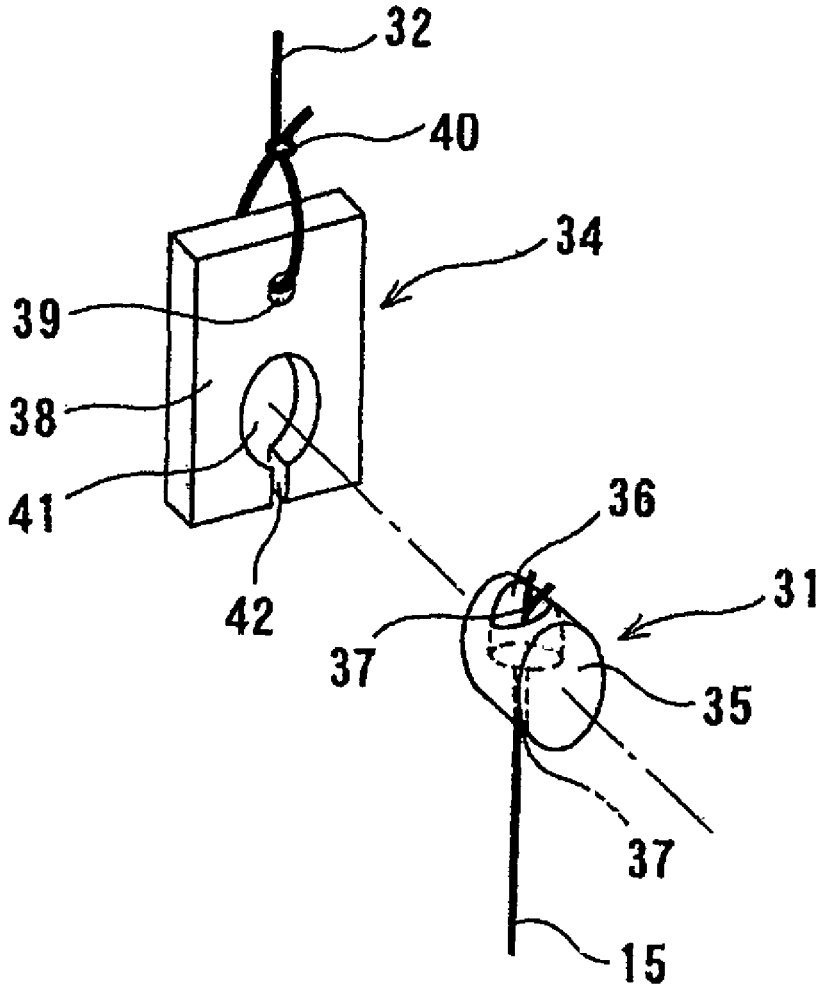
FIG. 5 is a perspective view enlarging to show a first connector and a second connector shown in FIG. 1.

As shown by FIG. 5, the first connector 31 includes an engaging member 35 having substantially the shape of a circular cylinder. A recess portion 36 is formed from a center portion of an upper portion to a center portion of an inner portion of the fitting member 35. A through hole 37 penetrating the fitting member 35 is formed from a bottom face of the recess portion 36, the screen tension member 15 is passed through the recess portion 36 by way of the through hole 37, a ring knot 37 is produced, and the first connector 31 is arranged at the front end of the screen tension member 15.

The second connector 34 includes a main body 38 in a plate-like shape. An upper end portion of the main body 38 is formed with a through hole 39 penetrating head and tail of the main body 38, the jump member 32 is passed through the through hole 39 from the back side to the surface side, and the second connector 34 is arranged at the front end of the jump member 32 by a ring knot 40. A lower end portion of the main body 39 is formed with a fitting hole 41 in a circular shape having an inner diameter substantially the same as or slightly smaller than an outer diameter of the engaging member 35 of the first connector 31, and a notch 42 is formed from a lower end of the fitting hole 41 to a lower end of the main body 38.

Both of the first connector 31 and the second connector 34 can be made of, for example, a resin. When the first connector 31 and the second connector 34 are coupled, the fitting member 35 is press-fit to the fitting hole 41. An interval of the notch 42 is widened, the fitting hole 41 is deformed to an outer side in accordance therewith, and the fitting member 35 is fitted to the fitting hole 41. The first connector 31 and the second connector 34 are coupled in a one touch manner and firmly. When the coupling is released, the fitting member 35 is extruded from the fitting hole 41. The coupling is released easily.

According to the above-described screen apparatus, the screen 2 is detachably attached to the screen attaching frame portion 1, the first connector 31 arranged at one end of the screen tension member 15, and the second connector 34 one end of which is connected to the vicinity of the free end 3*a* of the slide guide frame portion 3 and which is arranged at other end of the jump member 32 extracted to the side of attaching the screen 2 are made to be attachable and detachable, and therefore, the screen 2 can be changed in a state of extracting the slide guide frame portion 3 from the screen attaching frame portion 1 to some degree. When the screen 2 is detached from the screen attaching frame portion 1 and coupling of the first connector 31 and the second connector 34 is released, the screen 2 can be detached. When a new screen 2 is attached, the first connector 31 and the second connector 34 may only be coupled and the screen 2 may be only attached to the screen attaching frame portion 1. It is easy to change the screen 2, and the screen 2 can be changed at a portion of installation without detaching the screen apparatus. Also a user of the screen apparatus can change the screen 2.

Further, the first fold back portion 24 is provided at the attaching portion 2*a* to the screen attaching frame portion 1 of the screen 2, the screen tension member 15 is hung around the first fold back portion 24, the direction is changed, the second fold back portion 33 is provided on the side of attaching the screen 2 of the screen attaching frame portion 1, the jump member 32 is hung around the second fold back portion 33, the direction is changed, and therefore, in attaching the screen 2, complicated wiring is dispensed with, and the interchanging operation is further facilitated. Further, the first connector 31 and the second connector 34 which are coupled are made to be able to be moved between the first fold back portion 24 and the second fold back portion 33, and therefore, it is not necessary to pass the first connector 31 and the second connector 34 respectively through the first fold back portion 24 and the second fold back portion 33, and the screen tension member 15 and the jump member 32 are smoothly moved in accordance with contraction and development of the screen 2.

Further, the first fold back portion 24 is provided at a portion of a lower end portion of the attaching portion 2*a* of the screen 2, all of the 3 pieces of the screen tension members 15 are folded to bend to the first fold back portion 24, and hung around the first fold back portion 24, and therefore, a portion of the screen 2 which is not related to expansion of the screen tension member 15 can easily be cut, and a size of the screen 2 prepared for maintenance can be reduced.

Furthermore, the first fold back portion 24 is made so as to be integral with the screen 2 by being fixed to the attaching portion 2*a* of the screen 2 by making the attaching height adjustable, and therefore, the first fold back portion 24 can be changed simultaneously with changing the screen 2. Although when the first fold back portion 24 is arranged at the lower end portion of the screen 2, the first fold back portion 24 is easily damaged particularly by an influence of sand, mud or the like, also the first fold back portion 24 can be interchanged.

Figure 6:
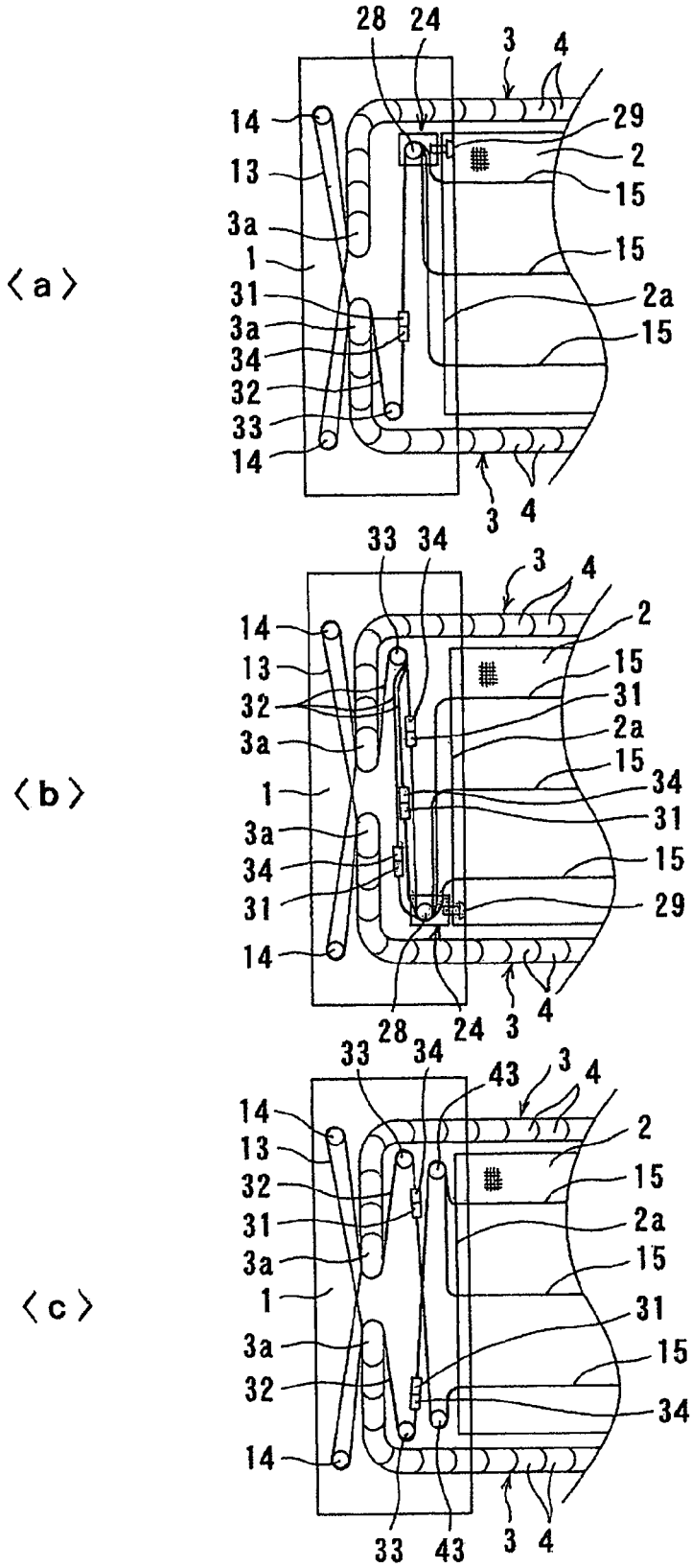
FIGS. 6 *<a><b><c>* are respectively sectional views of an essential portion generally showing other embodiments of the screen apparatus of the invention.
Figure 7:
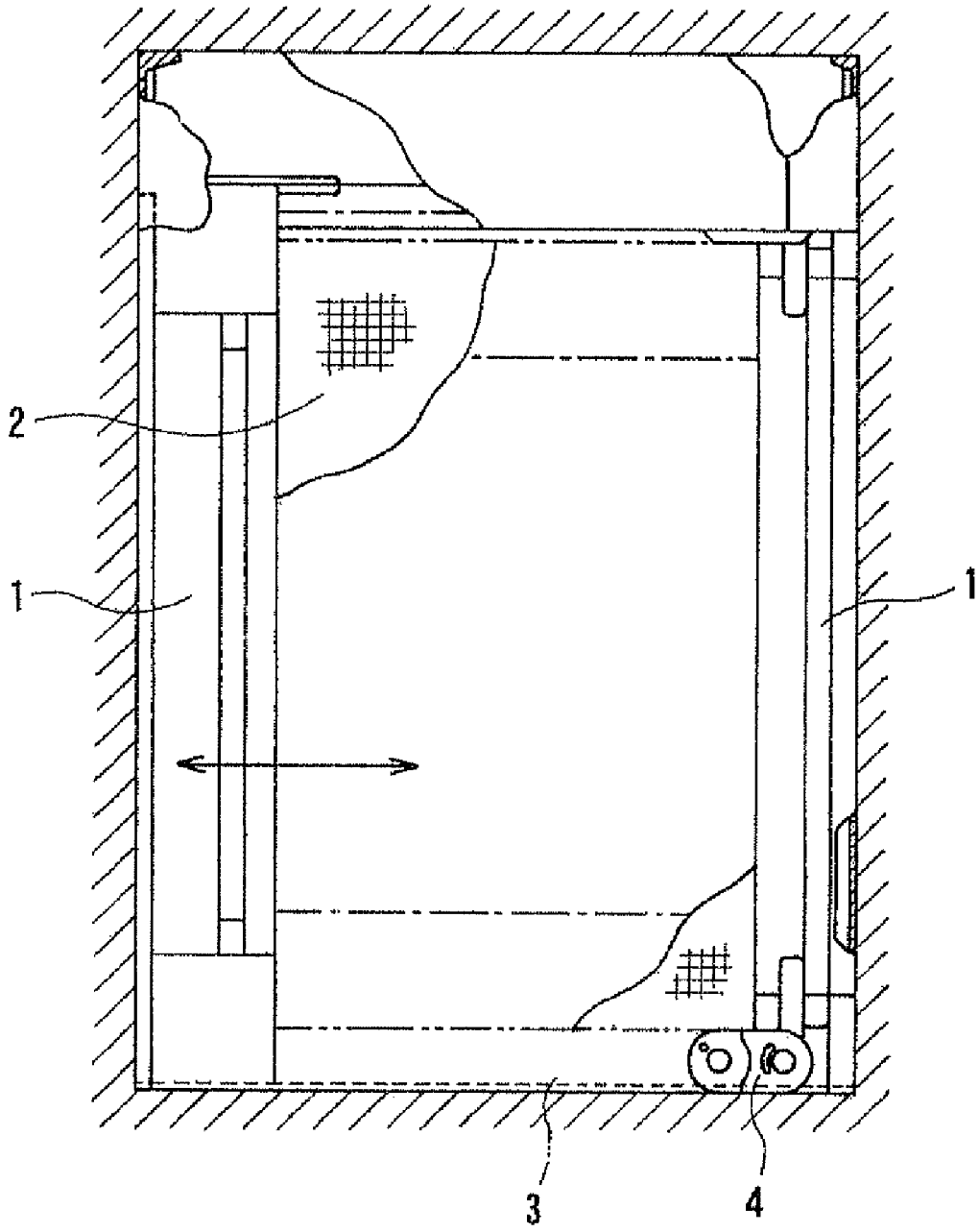
Fig. 7 PRIOR ART
FIG. 7 is a side view showing a screen apparatus provided by the applicant.
Figure 8:
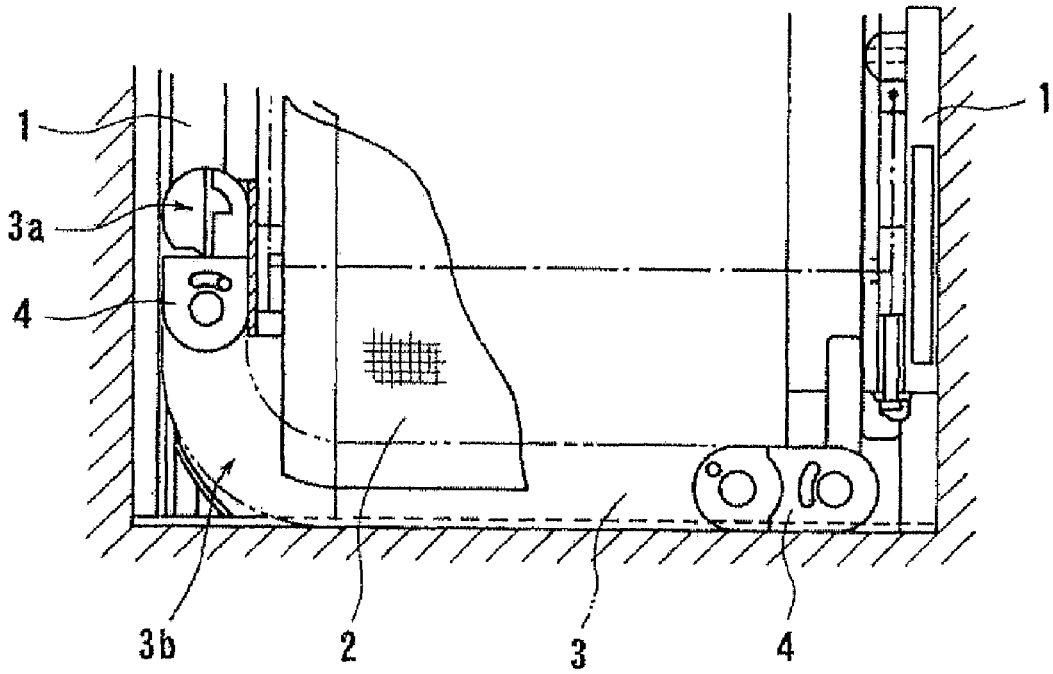
Fig. 8 PRIOR ART
FIG. 8 is a sectional view of an essential portion of the screen apparatus shown in FIG. 7.
Figure 9:
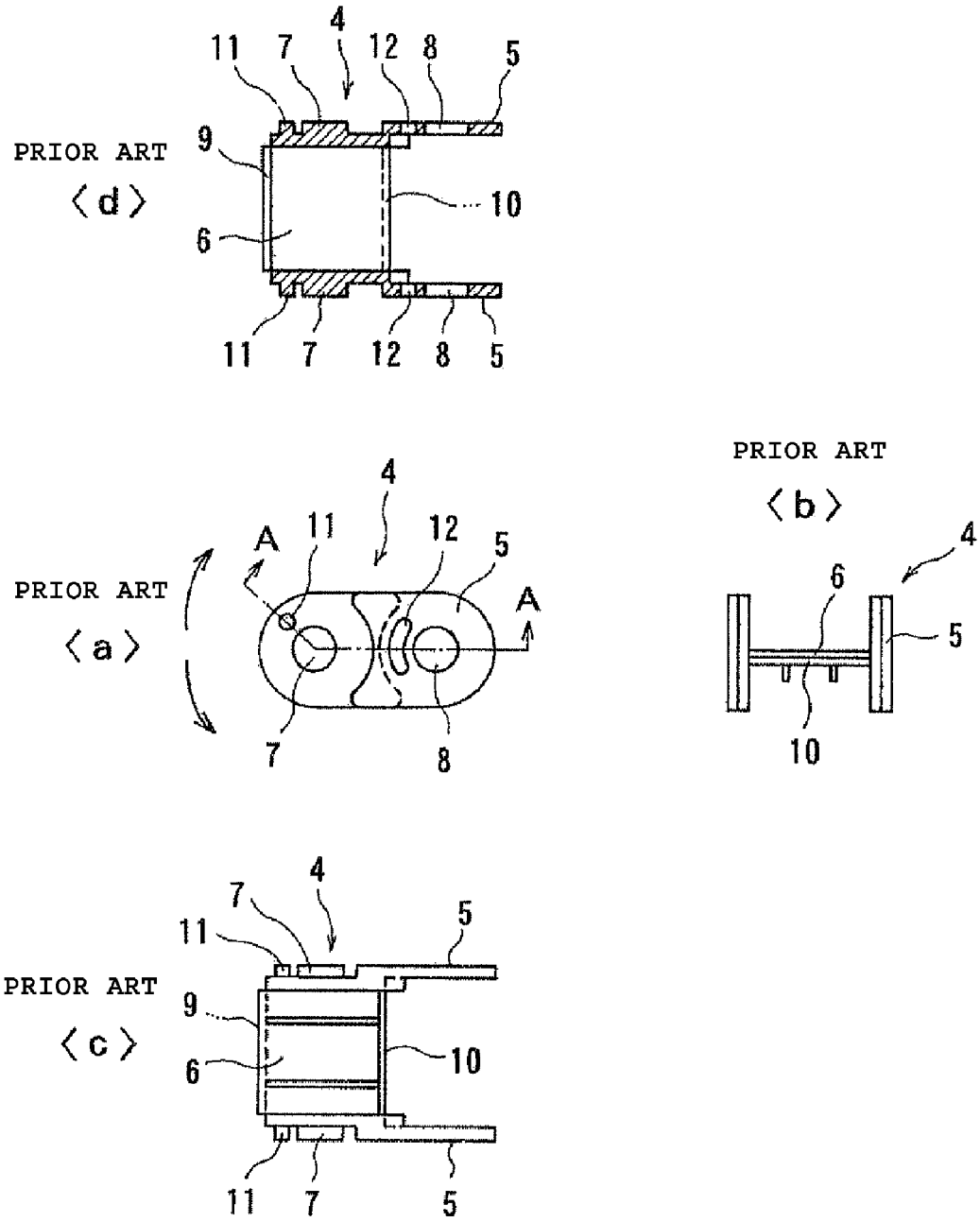
FIGS. 9 *<a><b><c><d>* are respectively a front view, a side view, a bottom view, and a sectional view taken along a line A-A exemplifying a rigid unit forming a slide guide frame portion of the screen apparatus shown in FIG. 7 and FIG. 8.
Figure 10:
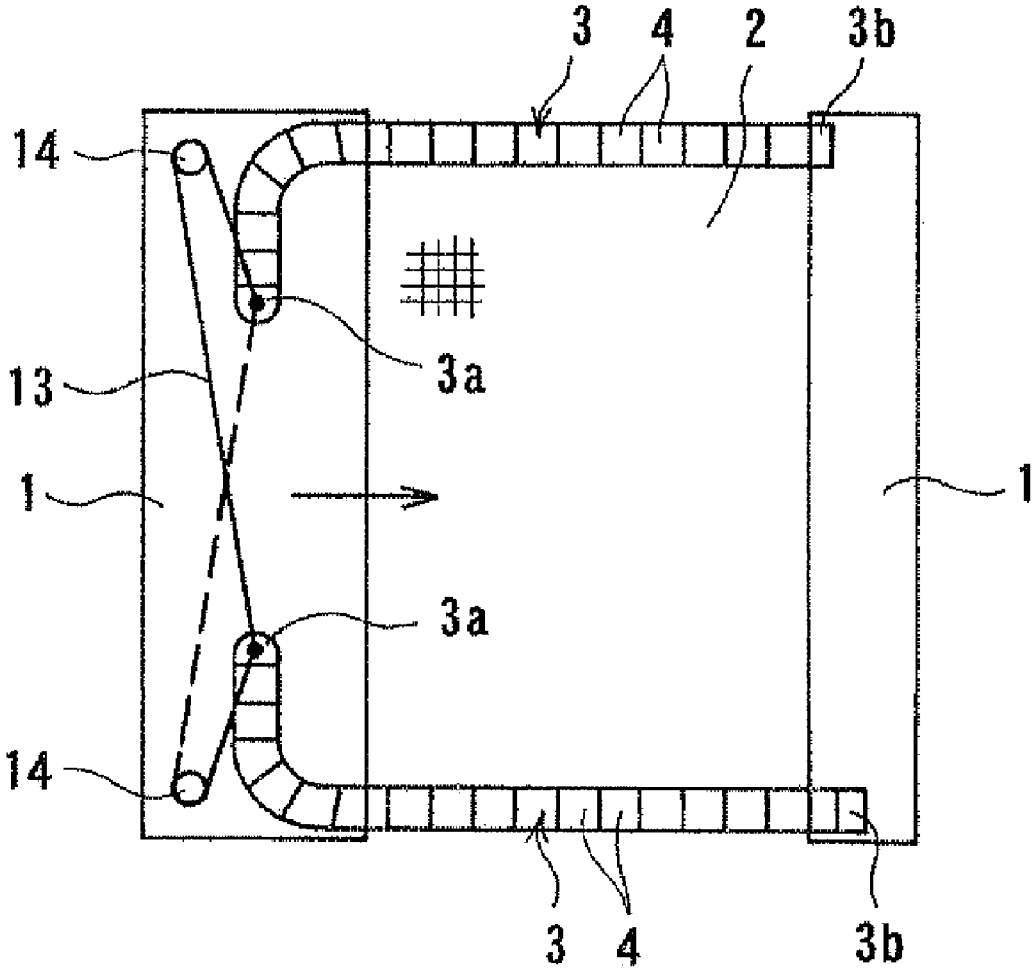
Fig. 10 PRIOR ART
FIG. 10 is a sectional view generally showing an essential portion of the screen apparatus provided by the applicant.

In the screen apparatus shown FIGS. 6 <*a*><*b*><*c*>, portions common to those of the screen apparatus shown in FIG. 4 are attached with the same notations and an explanation thereof will be omitted.

The screen apparatus shown in FIG. 6 <*a*> differs from the embodiment shown in FIG. 4 in that the first fold back portion 24 is provided at the upper end portion of the attaching portion 2*a* of the screen 2, the direction of the screen tension member 15 hung around the outer periphery of the roller 28 of the first fold back portion 24 is changed from the upper side to the lower side, further, at the inner portion of the screen attaching frame portion 1, the one end of the jump member 32 is connected to the vicinity of the free end 3*a* of the slide guide frame portion 3 on the lower side, the second fold back portion 33 is provided at the lower end portion on the side of attaching the screen 2, and the direction of the jump member 32 is changed from the lower side to the upper side. However, the screen apparatus shown in FIG. 6 <*a*> achieves an effect similar to that of the screen apparatus shown in FIG. 4.

According to the screen apparatus shown in FIG. 6 <*b*>, the 3 pieces of the screen tension members 15 are not summarized, respective front ends thereof are provided with the first connectors 31, also the 3 pieces of the jump members 32 that number the same as that of the screen tension members 15 are provided, respective front ends thereof are provided with the second connectors 34, and the first connectors 31 and the second connectors 34 are individually attached and detached. Although more or less time and labor is taken for attaching and detaching the first connector 31 and the second connector 34, except thereof. The screen apparatus shown in FIG. 6 <*b*> achieves an effect similar to that of the screen apparatus shown in FIG. 4.

According to the screen apparatus shown in FIG. 6 <*c*>, the first fold back portion 24 is not provided at the attaching portion 2*a* of the screen 2, third fold back portions 43 are provided on upper and lower sides of the side of attaching the screen 2 at the inner portion of the screen attaching frame portion 1, 2 pieces of the screen tension members 15 penetrating an upper portion and a center portion of the screen 2 are hung around the third fold back portion 43 on the upper side, the directions are changed from the upper side to the lower side, 2 pieces thereof are summarized and a front end thereof is provided with the first connector 31. One piece of the screen tension member 15 penetrating the lower portion of the screen 2 is hung around the third fold back portion 43 on the lower side, the direction is changed from the lower side to the upper side, and the front end is provided with the first connector 31.

Further, the second fold back portions 33 are provided on upper and lower sides of the side of attaching the screen 2 at the inner portion of the screen attaching frame portion 1, the jump member 32 one end of which is connected to the free end 3*a* of the slide guide frame portion 3 on the upper side is hung around the second fold back portion 33 on the upper side, the direction is changed from the upper side to the lower side, and the front end is arranged with the second connector 34. The jump member 32 one end of which is connected to the free end 3*a* of the slide guide frame portion 3 on the lower side is hung around the second fold back portion 33 on the lower side, the direction is changed from the lower side to the upper side, and the front end is arranged with the second connector 34.

Although according to the screen apparatus shown in FIG. 6 <*c*>, there is needed an operation of carrying out attachment and detachment of the first connectors 31 and the second connectors 34 at two portions, hanging the screen tension members 15 around the third fold back portions 43, wiring the screen tension members 15 and detaching the screen tension members 15 from the third fold back portions 43 in changing the screen 2, the screen 2 can be changed in a state of extracting the slide guide frame portion 3 from the screen attaching frame portion 1 to some degree. The screen 2 can be changed at the portion of installation without detaching the screen apparatus. Further, the first connector 31 and the second connector 34 which are coupled so as to be made to be movable between the first fold back portion 24 and the second fold back portion 33, and therefore, it is not necessary to pass the first connector 31 and the second connector 34 respectively through the first fold back portion 24 and the second fold back portion 33, and the screen tension member 15 and the jump member 32 are smoothly moved in accordance with contraction and development of the screen 2.

Further, although the above-described embodiment is a screen apparatus of a horizontals pulling type, the screen apparatus of the invention may be of a vertical pulling type, in that case, the screen apparatus of the vertical pulling type can be constituted quite similar to the screen apparatus of the horizontal pulling type.

The screen apparatus of the present invention facilitates changing a screen and is capable of changing the screen at the portion of installation without detaching the screen apparatus.

The invention claimed is:

1. A screen apparatus, comprising:

a screen having first and second end portions;

first and second screen attaching frame portions which are arranged so as to be opposed to each other, at least one of said first and second screen attaching frame portions being slidingly movable, said first and second screen attaching frame portions being attached to said screen, such that said screen is capable of being contracted and developed between said first and second screen attaching frame portions; and first and second slide guide frame portions arranged at vicinities of said first and second end portions of the screen, respectively, said first and second end portions of said screen not constituting sides of said screen being attached to said first and second screen attaching frame portions, wherein each of said first and second slide guide frame portions is formed by a plurality of rigid units, each rigid unit having a pair of side wall portions arranged opposite to each other and a bridging portion connecting said pair of side wall portions, said pair of said wall portions being pivotably connected between a pair of side wall portions of an adjacent rigid unit, so that said slide guide frame portions are flexible, wherein for each slide guide frame portion of said first and second slide guide frame portions, at least one end of said slide guide frame portion constitutes a free end and is capable of being contained in and extracted from inside said second screen attaching frame portion, and when extracted from the inside of said second screen attaching frame portion in accordance with a sliding movement of said second screen attaching frame portion, an extracted portion of said slide guide frame portion maintains linearity, wherein said free ends of said first and second slide guide frame portions are connected to each other by a slide guide frame portion tension member provided at the inside of said second screen attaching frame portion, said slide guide frame portion tension member forms a loop in substantially an 8 shape, and fold back points of said slide guide frame portion tension member are arranged on a side opposed to a side of said second screen attaching frame portion attaching said screen, and wherein said screen is detachable from at least said second screen attaching frame portion, a first connector is arranged at one end of a screen tension member, said screen tension member penetrating said screen at a plurality of portions in a length direction, a first end of a jump member is connected to said free end of said second slide guide frame portion, a second connector is arranged at a second end of said jump member, said jump member being disposed at a screen attaching side of said second screen attaching frame portion, the first connector and the second connector are made so as to be attachable and detachable from each other, and when in a state of extracting the first and second slide guide frame portions from the inside of the said second screen attaching frame portion, said screen is capable of being changed.

2. The screen apparatus according to claim 1, wherein a first fold back portion is provided at a portion of said screen attached to said second screen attaching frame portion, said screen tension member is hung around said first fold back portion, so as to change a direction thereof, a second fold back portion is provided on said screen attaching side of said second screen attaching frame portion, said jump member is hung around said second fold back portion, so as to change the direction thereof, and said first and the second connectors are configured to be coupled together and are movable between said first and the second fold back portions.

3. The screen apparatus according to claim 2, wherein said screen tension member is one of a plurality of screen tensions members, and all of said screen tension members are folded to bend to said first fold back portion, and hung around said first fold back portion.

4. The screen apparatus according to claim 2, wherein said first fold back portion is integral with said screen by being fixed to an attaching portion of said second screen attaching frame portion and enables an attaching height thereof to be adjustable.

5. The screen apparatus according to claim 3, wherein said first fold back portion is integral with said screen by being fixed to an attaching portion of said second screen attaching frame portion and enables an attaching height thereof to be adjustable.

* * * * *